US005519934A

United States Patent [19]

Dobrikow

[11] Patent Number: 5,519,934

[45] Date of Patent: May 28, 1996

[54] METHOD AND APPARATUS FOR LOCAL FORMING OF BRITTLE MATERIAL

[75] Inventor: Matthias Dobrikow, Osterode, Germany

[73] Assignee: Eckold GmbH & Co. KG, St. Andereasberg, Germany

[21] Appl. No.: 973,378

[22] Filed: Nov. 9, 1992

[30] Foreign Application Priority Data

Nov. 13, 1991 [DE] Germany ..... 9114122 U

[51] Int. Cl.[6] ..... B21D 39/03

[52] U.S. Cl. ..... 29/521; 72/379.2

[58] Field of Search ..... 72/264, 265, 348, 72/379.2, 355.6; 29/509, 521

[56] References Cited

U.S. PATENT DOCUMENTS

| | | | |
|---|---|---|---|
| 3,050,849 | 8/1962 | Etchison, Jr. et al. | 72/348 |
| 3,771,216 | 11/1973 | Johnson | 29/509 |
| 3,977,225 | 8/1976 | Couchman | 72/265 |
| 4,569,111 | 2/1986 | Mutou | 29/283 |
| 4,584,753 | 4/1986 | Eckold et al. | 29/243 |
| 4,757,609 | 7/1988 | Sawdon | 29/798 |
| 4,760,632 | 8/1988 | Rapp | 29/432 |
| 4,760,634 | 8/1988 | Rapp | 29/509 |
| 4,831,704 | 5/1989 | Rapp | 29/243 |
| 4,831,711 | 5/1989 | Rapp | 29/509 |
| 5,046,228 | 9/1991 | Eckold et al. | 29/243 |
| 5,051,020 | 9/1991 | Schleicher | 403/282 |

FOREIGN PATENT DOCUMENTS 2069394 2/1981 United Kingdom .

*Primary Examiner*—Lowell A. Larson
*Attorney, Agent, or Firm*—Townsend and Townsend and Crew

[57] ABSTRACT

Method for the local forming of material tending towards brittle fracture, such as certain aluminum alloys, in which during the forming tensile loads are exerted on the material, such as for example in joggle joining. Brittle fracture is avoided if the material is subjected to a pressure load in the region which is to be formed.

2 Claims, 2 Drawing Sheets

METHOD AND APPARATUS FOR LOCAL FORMING OF BRITTLE MATERIAL

BACKGROUND OF THE INVENTION

1. Field of the Invention

The present invention relates to a method for the local forming of brittle materials and to an apparatus for performing said method. The invention relates particularly, but not exclusively, to the joining of metal sheets by "joggle joining" techniques.

2. Description of the Background Art

Many methods for "joggle joining" of metal sheets are known. Reference may be made, for example, to EP-A-215,449, U.S. Pat. Nos. 4,757,609, and 5,046,228. The disclosures of each of these references are incorporated herein by reference. A common feature of all these methods is that metal sheets are laid flat one upon the other and that material in both sheets is locally joggled, i.e., pressed by a punch into a cavity, care being taken to ensure that the material of the sheets in the region to be joined is tightly clamped together.

This technique has been adopted as an economical production method in many fields, for example in motor vehicle manufacture, in air conditioning and in machine construction when mass production is required.

Known joggle joining tools generally comprise a die defining a cavity into which the sheet material is deformed by means of a punch. An anvil forming the die bottom is disposed opposite the working surface of the punch. Joggle joining tools are known in which the anvil is spring preloaded. U.S. Pat. No. 3,771,216 discloses an arrangement of this kind in which an anvil and spring combination serves as an ejector intended to remove the joint from the die. U.S. Pat. No. 4,584,753 discloses a die where, in the rest position, the anvil projects beyond the edge of the die under spring preloading. The projecting portion of the anvil serves as centering means intended to position a pre-perforated sheet in relation to the die and the punch. In both cases, however, the force produced by the spring is some orders of magnitude less than the forces which are to be applied in accordance with the present invention. The disclosures of both these patents are incorporated herein by reference.

These joining methods can be applied to many metals and plastics materials. However, it has not hitherto been possible to join brittle materials, such as for example certain aluminum alloys, by such techniques, because their strainability is insufficient. As a general rule such brittle materials can undergo non-cutting forming only within a narrow range of material deformations.

It has hitherto not been known what phenomena underlie the empirically established fact that brittle fractures do not occur in forming carried out under an additional pressure load, whereas the same degree of forming without such a pressure load must of course remain within the elastic range of the stress-strain diagram, and is compensated in the forming, in which of course the entire elastic range must necessarily be passed through before plastic deformation occurs.

The object of the invention is to indicate a method which permits greater deformation of brittle materials than was possible hitherto. In particular, the joggle joining of sheets of brittle aluminum alloys is to be made possible.

SUMMARY OF THE INVENTION

The present invention provides a method and apparatus for joining metal sheets which is suitable for a variety of materials, including brittle materials such as brittle aluminum alloys which are often resistant to conventional joining methods. The apparatus comprises a die defining a cavity and a punch which is in reciprocatable alignment with the die cavity. An anvil is reciprocatably disposed within the cavity and moves between a retracted position (where it forms the lower or innermost surface of the die cavity) and an extended position where it is flush with or extends beyond an upper die surface. The anvil is resiliently mounted within the die cavity, typically by a compression spring arrangement.

In the method of the present invention, the sheets to be joined are placed side by side between the punch and the upper die surface. The region to be joined will be initially held between the punch and a forming surface of the anvil (which is initially flush with or extending above the upper die surface). The punch is then lowered relative to the die, compressing the sheets together and simultaneously deforming them into the die cavity. The deformation and compression forces will be defined simultaneously by the force of the die against the spring force of the anvil. Once the anvil is fully retracted, its travel will be stopped, permitting a final overpressure of the punch to complete the bond between the sheets. By utilizing an anvil with a chamfered end, the bond between the sheets can be enhanced by flowing metal into the void left by the chamfer.

DESCRIPTION OF SPECIFIC EMBODIMENTS

Figure 1:
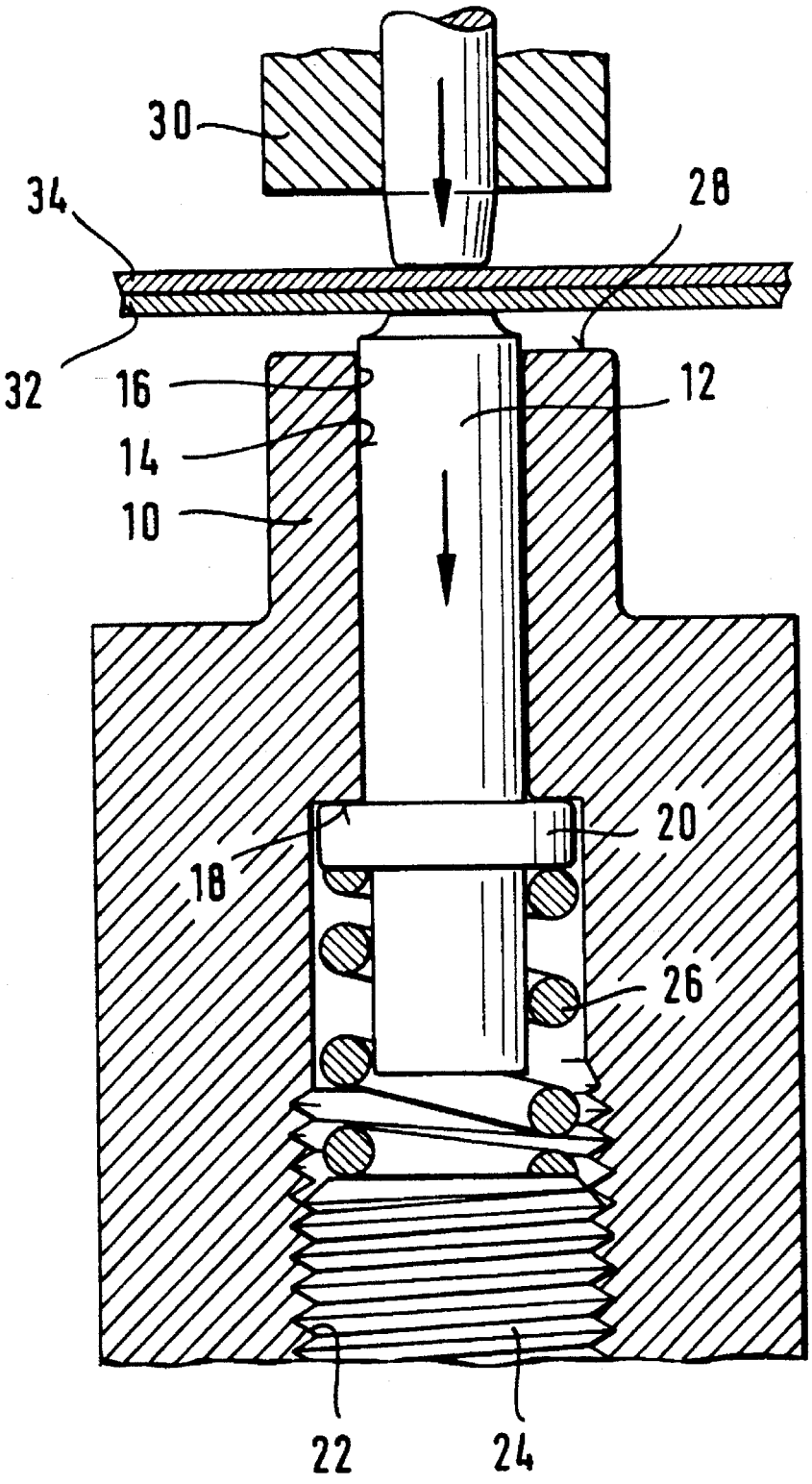
FIG. 1 is a side elevational view of an apparatus suitable for performing the method of the present invention, shown in section.
Figure 2:
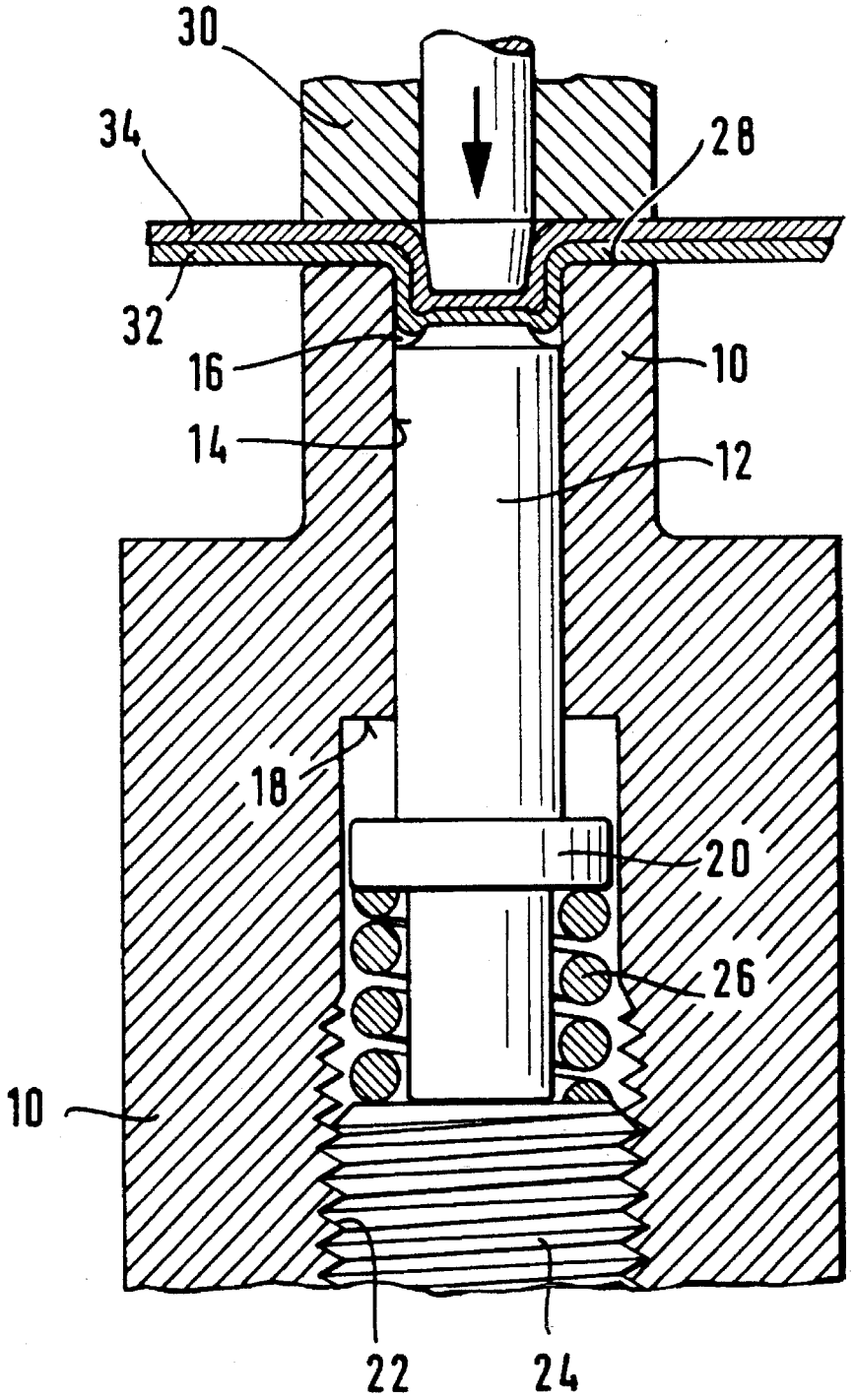
FIG. 2 is similar to FIG. 1, shown with the two sheets of metal joined.

A simple exemplary embodiment of an apparatus for applying the method according to the invention is illustrated schematically in the accompanying drawings and explained more fully below. FIG. 1 of the drawings shows the position of the components (for the sake of simplicity shown in cross-section) at the beginning of the joining operation, and FIG. 2 shows them at the end of the joining operation, in axial section in each case.

An anvil 12 is slidably mounted in a die 10, being guided in a bore 14 in the latter. The top portion of the anvil 12 is chamfered to form a projection. A shoulder 18 serves as top stop for a collar 20 formed on the anvil 12. In the adjoining bottom part of the die bore 14, which has a larger diameter, a screw thread 22 is cut, into which a bottom stop 24 is screwed. Between the bottom stop 24 and the collar 20 of the anvil 12, a strong spring, for example, a helical compression spring 26, is clamped and urges the anvil 12 into an upwardly extended position, as shown in FIG. 1. It can be seen that, before the joining operation, the anvil 12 projects out beyond the working end face 28 of the die to expose its chamfered projection.

A punch 30, driven for example by a hydraulic unit (not illustrated), initially clamps sheets 32, 34, (which may be brittle aluminum alloys) which are to be joined together, between a lower working face of the punch and the chamfered projection of anvil 12, so that the sheet material is subjected to a pressure load corresponding to the force of the spring 26. The initial spring force will usually be at least about 1000N, being 3000N (corresponding to a pressure of $110N/nm^2$) in the illustrated embodiment. During the joining operation this pressure load is increased until the anvil 12 is forced back into the die bore 14, while surprisingly no fracture of material occurs. Finally, the anvil 12 rests on the bottom stop, and the punch 30 presses the material of the sheets 32 and 34 into the space left free by the chamfer on the anvil, so that the sheets are clamped together. It can be seen that the pressure load acts not only before but also during the joggling. The spring 26 will provide a final force of at least about 5000N. When fully compressed, being about 8000N (corresponding to a pressure of 285N/mm$^2$) in the exemplary embodiment.

After the sheets 32 and 34 are clamped together as just described, the sheets are locally formed and joined, typically by joggling.

The methods of the present invention are particularly suitable for joining brittle aluminum alloys together, such as AlMgSi 0.5, AlMgSi 0.8, AlMgSi 1, and AA2219. The first three of these alloys are designated pursuant to German DIN standards.

In order to facilitate extraction, the die may be hinged so that it can be opened and may be undercut in the region of the cavity, all of which is already known in joining tools but may also be advantageously applied here.

Although the foregoing invention has been described in detail for purposes of clarity of understanding, it will be obvious that certain modifications may be practiced within the scope of the appended claims.

What is claimed is:

1. A method of joining a first metal sheet to a second metal sheet, at least one of said sheets being made of brittle material, the method comprising the steps:

placing the two sheets together and between a punch member and an anvil member having a chamfer and being surrounded by a die member, said anvil member being adapted to be displaced from an initial position where it extends beyond a die surface to an end position within said die member thereby defining a cavity, said anvil member being biased towards said initial position by means of a spring;

displacing said sheets and said anvil member towards said end position by pressing said punch member against said sheets until the sheet facing the anvil member abuts said die surface whereby bias force produced by said spring increases to a first predetermined value so as to improve ductility of said brittle material, displacing sheet material between said punch member and said anvil member into said die cavity whereby said bias force produced by said spring increases to a second predetermined value; and when the anvil member has reached its end position; compressing sheet material within said die cavity between said punch member and said anvil member to cause cold flow of said material into a space between an inner die member wall and said anvil chamfer.

2. A method as in claim 1, wherein the first and second metal sheets are each composed of a brittle aluminum alloy.

* * * * *